US005848732A

United States Patent [19]

Brugger

[11] Patent Number: 5,848,732

[45] Date of Patent: Dec. 15, 1998

[54] DISPENSER FOR A LIQUID MEDIUM CONSISTING OF TWO COMPONENTS

[76] Inventor: Gerhard Brugger, Schongauer Strasse 10, D-87616 Marktoberdorf, Germany

[21] Appl. No.: 686,124

[22] Filed: Jul. 23, 1996

[30] Foreign Application Priority Data

Jul. 24, 1995 [DE] Germany ..... 295 11 932 U

[51] Int. Cl.[6] ..... B67D 5/52

[52] U.S. Cl. ..... 222/137; 222/145.8

[58] Field of Search ..... 222/134, 135, 222/145.6, 145.7, 145.8, 257, 137

[56] References Cited

U.S. PATENT DOCUMENTS

| | | | |
|---|---|---|---|
| 3,760,986 | 9/1973 | Castner et al. | 222/137 |
| 4,771,919 | 9/1988 | Ernst | 222/145.7 |
| 4,773,562 | 9/1988 | Gueret | 222/135 |
| 4,826,048 | 5/1989 | Skorka et al. | 222/135 |
| 4,893,729 | 1/1990 | Iggulden et al. | 222/145.7 |
| 5,158,438 | 10/1992 | Olson et al. | 417/360 |
| 5,169,029 | 12/1992 | Behar et al. | 222/145.7 |
| 5,385,270 | 1/1995 | Cataneo et al. | 222/145.8 |

FOREIGN PATENT DOCUMENTS

| | | |
|---|---|---|
| 26902 | 4/1981 | European Pat. Off. . |
| 427609 | 5/1991 | European Pat. Off. . |
| 520315 | 12/1992 | European Pat. Off. . |
| 676339 | 10/1995 | European Pat. Off. . |

*Primary Examiner*—Philippe Derakshani
*Attorney, Agent, or Firm*—Brooks Haidt Haffner & Delahunty

[57] ABSTRACT

The present invention generally refers to a dispenser for a liquid medium consisting of two components. The dispenser in particular comprises two accomodation compartments for two different components of the material to be dispensed. Each of the accomodation compartments has an outlet and a mixer connected thereto. The mixer is manually adjustable by an adjuster and changes the ratio of the supplied components of the medium. Finally, the dispenser comprises a dispenser nozzle for the medium to be dispensed, which is connected to the mixer.

5 Claims, 7 Drawing Sheets

DISPENSER FOR A LIQUID MEDIUM CONSISTING OF TWO COMPONENTS

BACKGROUND OF THE INVENTION

Bottles and cans are available for accomodating liquid media for every day use, such as washing-up liquid, liquid soap, perfumes, sun tan lotion and the like, said bottles or cans being provided with an upper part in which a manually operable pump is disposed, by means of which the content of the container may be pumped to a dispenser nozzle. Containers of this kind are generally known.

A device for dispensing liquid agents to be mixed at a given ratio is known from DE-OS 33 16 922, said device having a plunger-cylinder system having a number of juxtaposed cylinders including a rejection plunger each, said number corresponding to the amount of agents to be mixed. These cylinders are the reservoirs for the agents to be dispensed, and their effective volume is reduced by displacing the plungers upon an increase in consumption. All plungers are moved by a spindle mechanism which can be operated at a hand wheel.

A dispenser for a hair dye is known from EP-A-0 510 352, said dispenser containing a second container, accomodating a hair dye developer, in a first container, accomodating a propellant. The dispenser further comprises an output nozzle and a valve structure having first and second valves, that are connected to both containers and the output nozzle and that are operated simultaneously to enable a simultaneous output of the liquids contained in the first and second containers under the The present invention refers to a dispenser for a liquid medium consisting of two components influence of the propellant, wherein the mixing ratio of the container contents is not changed at the output nozzle.

BRIEF DESCRIPTION OF THE INVENTION

There are applications in which a person intends to personally adjust or change the mixing ratio of the liquid consisting of two components according to his/her own desire. Sun tan lotion is a typical example. The un-irradiated skin of the human being is more sensitive to solar radiation than tanned skin. If the skin is exposed to the sun for the first time, a higher light protection factor has to be chosen than if the skin is more or less tanned by the sun. In order not to need a variety of sun tan lotion of different light protection factors, there is a need for a sun tan lotion with which the light protection factor can be adjusted individually. Since this can practically only be accomplished by mixing two different sun tan lotions of differently high light protection factors, the dispenser for a liquid medium was developed, which can dispense two liquid components at a freely selectable mixing ratio.

This object is accomplished by the invention cited in claim 1. Advantageous further developments of the invention are subject matter of the subclaims.

In the scale of the invention, two concepts are possible, namely a concept in which the outlets of two accomodation compartments of a container for different, liquid media are directly connected to a mixer, the mixing ratio of which being adjustable and the output of which possibly being connected through a pump with a dispenser nozzle, and another concept, in which the outlets of two accomodation compartments are connected to a separate pump, the outlets of which being connected to a common mixer and the supply volumes of which being mutually adjustable.

The advantage of the concept including the two pumps is that after changing the mixing ratio, the newly adjusted ratio is obtained relatively quickly at the dispenser nozzle. In the other concept it is possible only after some pump operations to achieve the newly adjusted ratio.

BRIEF DESCRIPTION OF THE DRAWINGS

The invention will now be described by reference to the embodiments shown in the drawings.

DETAILED DESCRIPTION OF THE INVENTION

Figure 1:
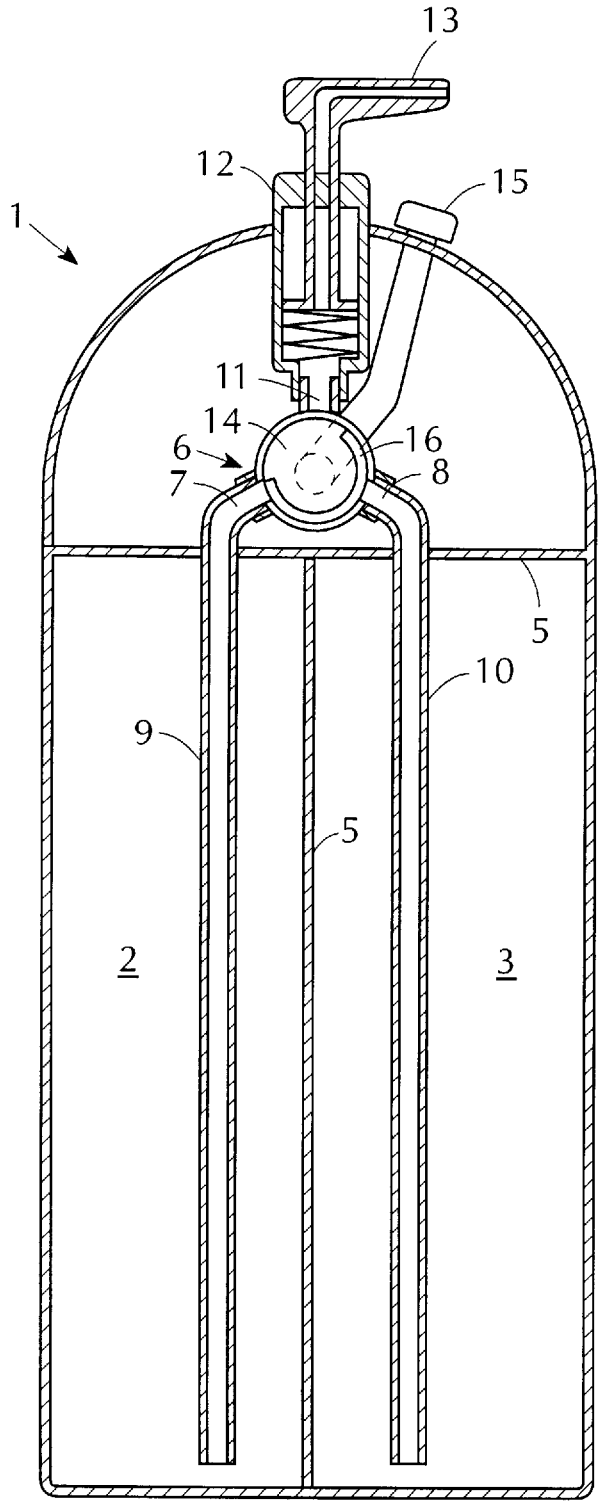
FIG. 1 is a first embodiment of the invention with an adjustable mixer.

A container indicated by 1 can be seen in FIG. 1, said container having in its interior two accomodation compartments 2 and 3 and the container being divided in a head chamber 4 by walls 5. A mixing valve 6 is disposed in the head chamber 4, said mixing valve having two inlets 7 and 8 to which suction lines 9 and 10 are connected as outlet means of the accomodation compartments 2 and 3. The mixing valve 6 has an outlet 11 to which a discharge pump 12 is connected which is provided with a dispenser nozzle 13.

Figure 2:
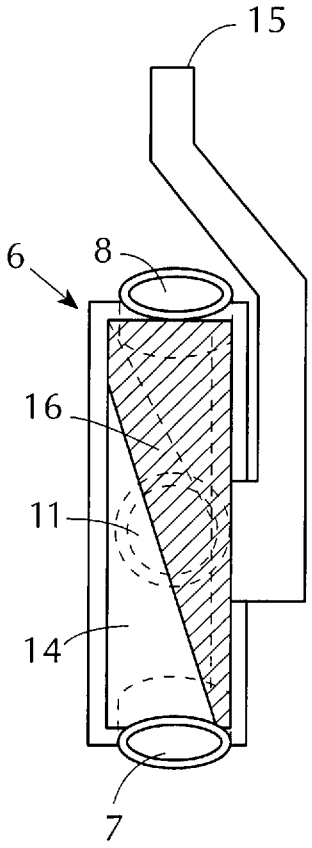
FIG. 2 is a sectional view of the mixer of the embodiment of FIG. 1.

According to FIGS. 1 and 2, the mixing valve 6 has a mixing chamber 14, into which the inlets 7 and 8 open. Furthermore, it contains an adjustment lever which is connected with a rotary valve 16 disposed within the mixing chamber, by means of which the opening cross-sections of the inlets 7 and 8 into the mixing chamber 14 can be mutually infinitely varied.

If the discharge pump 12 is operated by pressing onto the dispenser nozzle 13, the liquid is pumped from the container 1 to the dispenser nozzle 13, as is common in perfume atomizers, liquid soap dispensers and the like. The mechanism needed for this purpose does not have to be defined any closer, since it is generally known. The mutual ratio of the liquid, that are pumped out of the accomodation compartments 2 and 3 depends on the position of the rotary valve 15 in the mixing chamber 14 and to a certain extent also on the viscosity of the supplied liquid, if it is not the same in both liquids.

Figure 3:
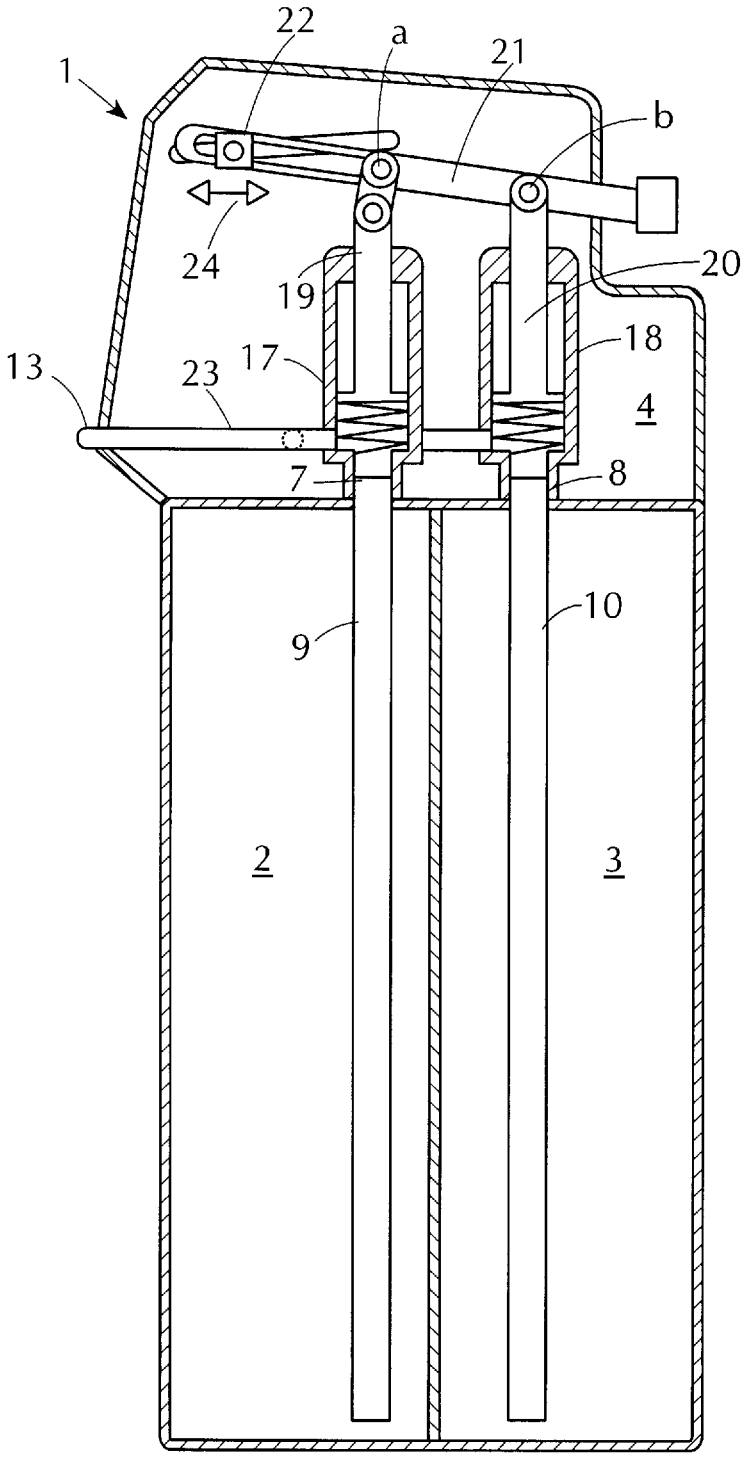
FIG. 3 is an embodiment with two pumps having mutually adjustable supply volumes.

FIG. 3 shows an embodiment of the invention with a container 1 divided into two accomodation departments 2 and 3 and into a head chamber 4. Two pumps 17 and 18 are disposed within the head chamber, the inlets 7 and 8 of which being connected to suction lines 9 and 10 which project into the accomodation compartments 2 and 3. The pumps 17 and 18 have plungers, the plunger rods 19 and 20 of which being connected to a common pump lever 21 at different positions a and b, which have different spacings from a pivot bearing 22 of the lever 21.

The outlets of the pumps 17 and 18 are connected to a common mixing pipe 23, which leads to a dispenser nozzle 13.

According to FIG. 3, the location of the pivot bearing 22 of the pump lever 21 is adjustable towards the left and towards the right. This is shown in FIG. 3 by the arrow 24. Since the supply volumes of the pumps 17 and 18 at a given pivot angle of the pump lever 21 are defined by the spacings of the points a and b to the pivot bearing 22, the ratio of the volumes of the pumps 17 and 18 supplied per pump lever stroke and thus the ratio of the dispensed components of the accomodation compartments 2 and 3 can be altered by adjusting the pivot bearing 22 according to arrow 24. It is understood that the adjustment mechanism for the pivot bearing 22 is accessible from the outside, e.g. As a turning knob of a spindle drive.

Finally it has to be mentioned that the accomodation compartments shall be refillable in order to use the dispenser in a quite economical way.

Figure 4:
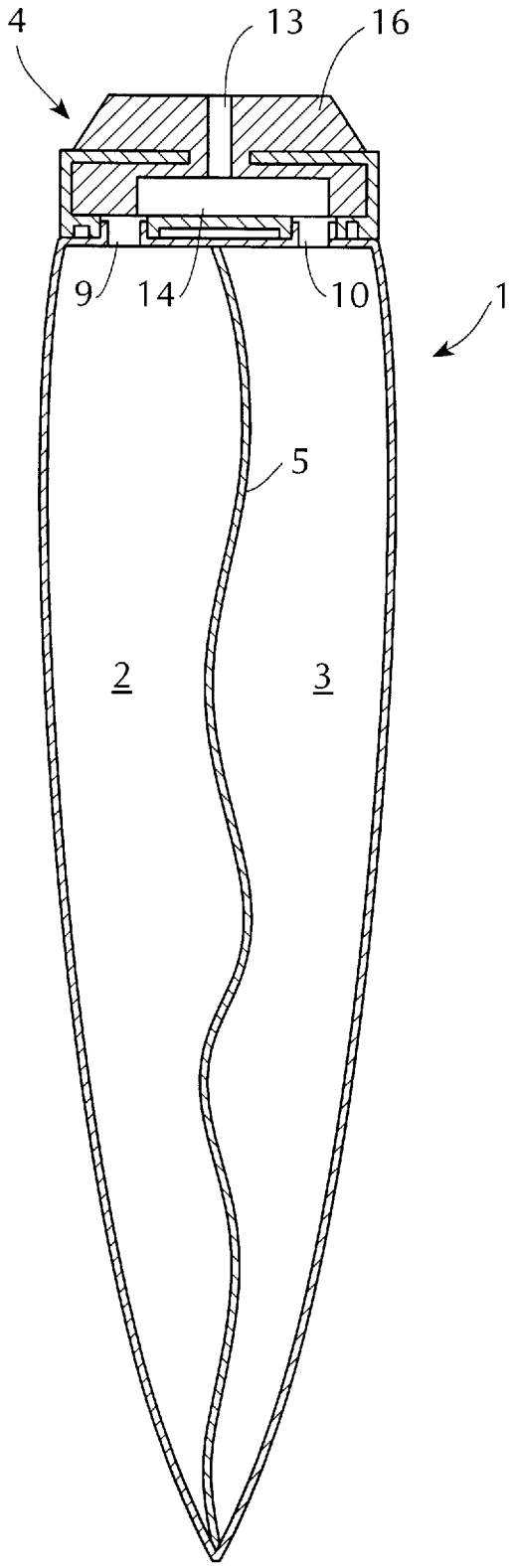
FIG. 4 is an embodiment having a twin-chamber tube with an adjustable mixing and output head.

FIG. 4 shows an embodiment with a tube as a container, the interior of which being divided by a diaphragm 5 into two chambers 2 and 3. The tube is closed at its upper end by a head 4 of a circular shape. The chambers 2 and 3 have outlets 9 and 10 at their upper ends, said outlets diametrically facing each other with respect to the axis of the tube head 4, and the outlets open into the tube head 4, in which a rotary body 16 is rotatably retained about the axis of the tube head 4. The rotary body 16 has a circular, eccentrically disposed recess at its lower side facing the outlets 9 and 10, said recess forming a mixing chamber 14 located above the outlets 9 and 10. The rotary body has a central dispenser nozzle 13 which is connected to the mixing chamber 14.

Owing to the eccentric arrangement of the recess provided in the mixing chamber 14, the outlets 9 and 10 are closed to different degrees by the lower front face of the rotary body according to the rotary position of the rotary body. By turning the rotary body 16, the ratio of the free cross-sectional surfaces of the outlets 9 and 10 can be changed and thus the mutual proportions of the contents can be varied that flow out of the tube chambers 2 and 3 when pressing the tube.

It has to be emphasized that the invention can also be realized with a container, in which two inner bags that can be pressed out or an inner bag that can be pressed out which is divided by a diaphragm exists, which can be pressed together by a punch provided in the container, which can be operated from the outside. The means that can be seen in FIG. 1 top or FIG. 4 top can be used as a mixing or outlet means.

A further possibility is to add a propellant to the liquids in the accomodation compartments 2, 3, said propellant taking over the function of driving the liquids. In this case a pump is no longer required.

Figure 5A:
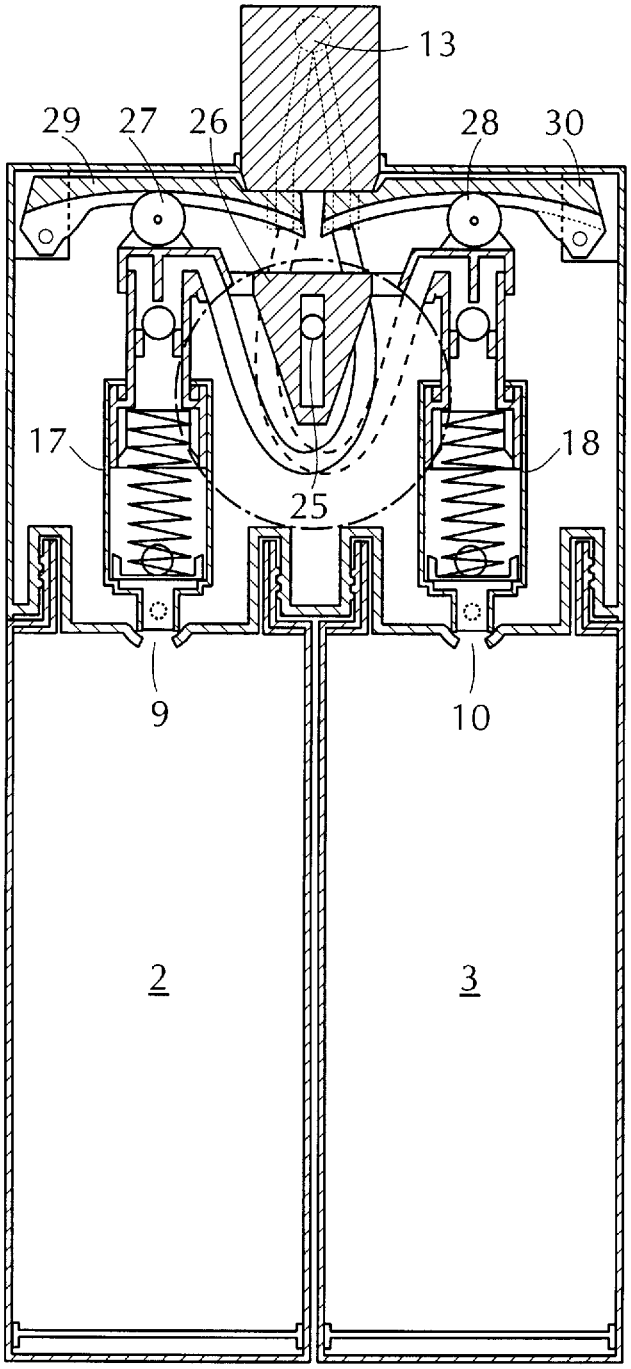
FIG. 5 is a further embodiment with two pumps in a front view, a side view and top view.
Figure 5B:
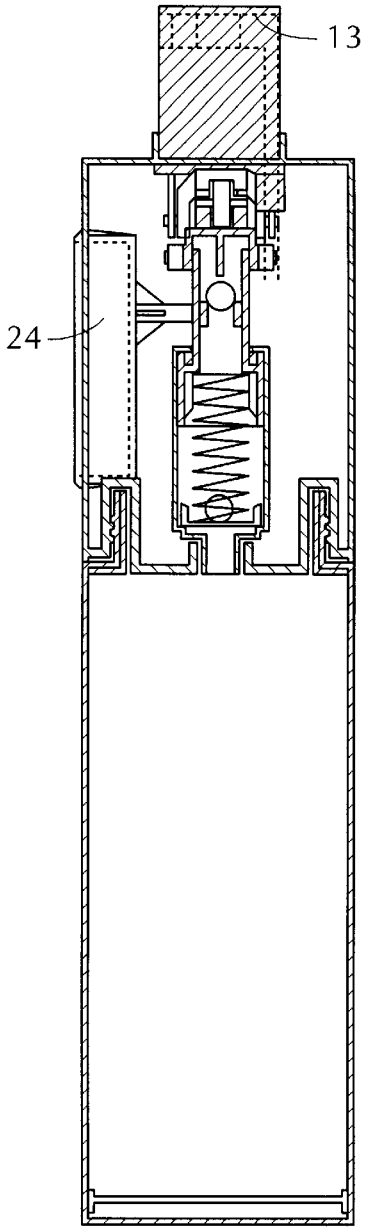
Figure 5C:
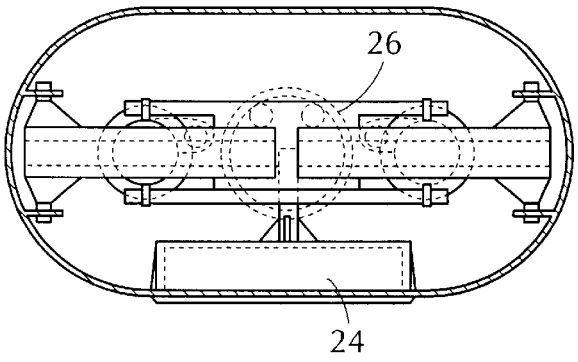
Figure 6:
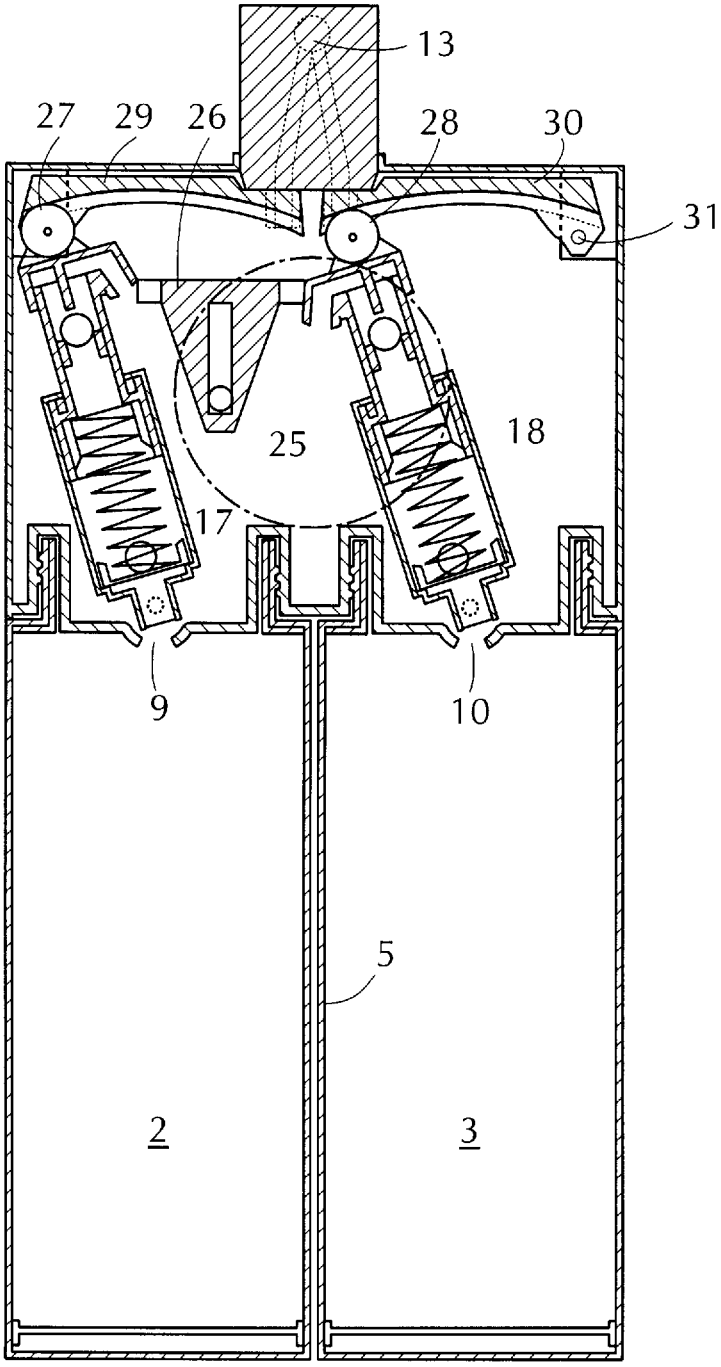
FIG. 6 is a view of the embodiment of FIG. 5 in a front view, wherein the supply volume of the pumps is changed with respect to the view of FIG. 5.

FIGS. 5 and 6 show a further embodiment of the dispenser according to the invention having two pumps. Those portions of this embodiment that correspond to those of the above-mentioned embodiments, are characterized by the same reference numerals and are thus not further described.

The substantial difference of the embodiment of FIG. 5 and 6 with respect to those of FIG. 3 is the differently designed adjustment means.

The adjustment means in this case consists of an operating element 24 to be operated by the operator from the outside for adjusting the ratio of the liquids. The operating element 24 is rotatably supported in a correspondingly formed opening in the container 1. A bearing pin 25 projects from the side of the operating element facing the interior of the container, said bearing pin being guided in a longitudinal slot of a coupling element 26 (compare the view top left in FIG. 5). The coupling element is connected to the two pumps 17, 18 and is pivoted when rotating the operating element together with the pumps 17, 18 (FIG. 6). The upper ends of the pumps 17, 18 have bearing rollers 27, 28, that are guided in guiding rails 29, 30. This enables a pivot movement of the pumps along a circular-sector shaped path. The guide rails 29, 30 each have a pivot bearing 31 located in the proximity of the outer wall of the container 1. Thereby, the guide rails 29, 30 at the same time act as lever arms to transfer a pressure, exerted on the dispenser nozzle 13 vertically downwards, to the plunger rods of the pumps 17, 18.

If the bearing pin is in the position shown in FIG. 5, the stroke of the two pumps 17, 18 is equally great. In contrast thereto, the stroke of the pump 18 shown in the position of the bearing pin 25 in FIG. 6, is at its maximum and the stroke of the pump 17 is at its minimum. The person skilled in the art recognizes that the ratio of the liquids to be supplied is infinitely variable. The outlet openings of the pumps 17, 18 are connected to the dispenser nozzle 13 through flexible hose lines, as can be seen from the front view of the dispenser in FIG. 5. For reasons of clarity, the hose lines are not drawn in FIG. 6. The dispenser nozzle 13 has a mixing pipe, as is shown in the embodiment of FIG. 3.

It has to be emphasized in the embodiment of FIGS. 5 and 6 that the bottom of the accomodation compartments "moves along" to prevent the generation of air bubbles, in particular if the dispenser is not in an upright position.

Figure 7:
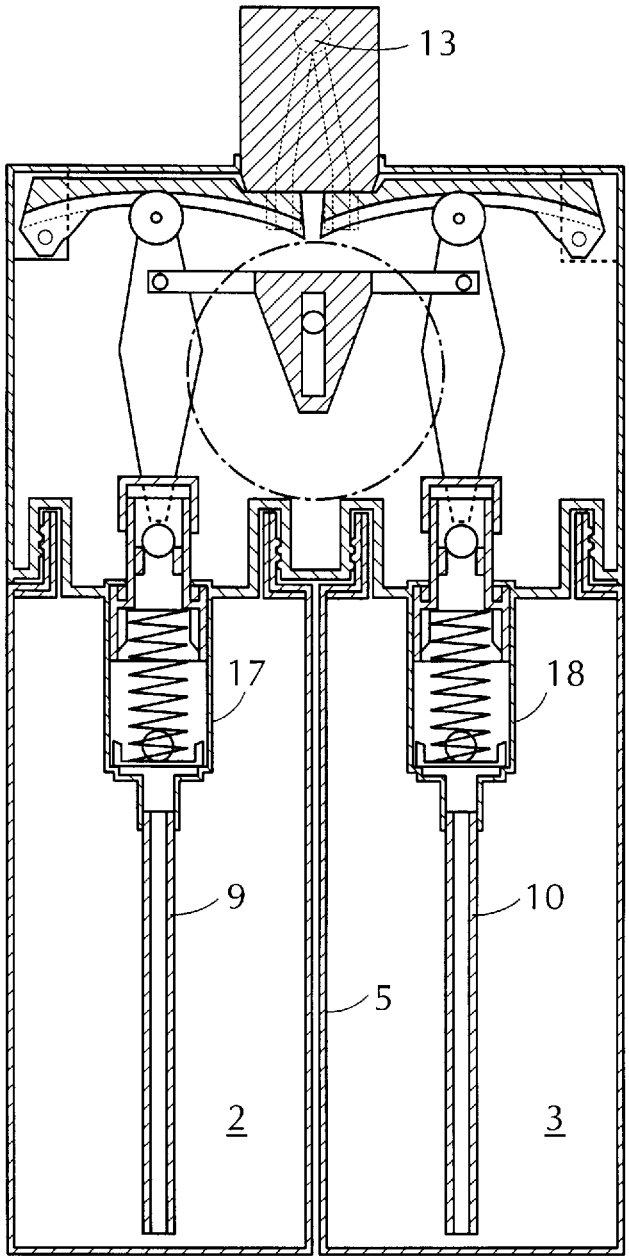
FIG. 7 is an alternative of the embodiment of FIGS. 5 and 6.

The alternative of the dispenser shown in FIG. 7 shows an embodiment with two suction lines 9, 10 similar to FIG. 3.

What is claimed is:

1. A dispenser for a liquid medium, consisting of a container divided into two accommodation compartments for two different components of the medium to be dispensed, an outlet opening at each of the accommodation compartments, a mixing means connected to each outlet opening, a manually adjustable adjustment means by means of which the ratio of the components of the medium supplied to the mixing means can be adjusted, a dispenser nozzle for the medium to be dispensed by the dispenser which nozzle is connected to the mixing means, wherein the outlet openings are each connected to a discharge pump having a plunger, the outlets of which open into a common mixing line leading to the dispenser nozzle, and the discharge pumps being pivotally retained at guide rails, wherein the guide rails are at the same time supported at the container as pivotal operating levers for the plungers of the pumps.

2. A dispenser according to claim 1, wherein the pumps are connected to one another through coupling elements and the coupling elements are engaged by an operating element in a manner that upon operation thereof a pivot movement of the pumps is caused, which causes the lengths of the operating levers acting at the pumps to be changed.

3. A dispenser according to claim 1, wherein the outlets of the discharge pumps are connected to the mixing line (23) through flexible hose lines.

4. A dispenser according to claim 2 wherein the outlets of the discharge pumps are connected to the mixing line through flexible hose lines.

5. A dispenser according to any one of the preceding claims wherein the accommodation compartments have bottoms which are movably supported and move to reduce the volume of the accommodation compartments as they are emptied of the medium.

* * * * *

UNITED STATES PATENT AND TRADEMARK OFFICE

CERTIFICATE OF CORRECTION

PATENT NO. : 5,848,732

DATED : December 15, 1998

INVENTOR(S) : GERHARD BRUGGER

It is certified that error appears in the above-identified patent and that said Letters Patent is hereby corrected as shown below:

Column 1, line 4, after "BACKGROUND OF THE INVENTION" insert the following paragraph: --The present invention refers to a dispenser for a liquid medium consisting of two components.--

Column 1, lines 32-33, delete "The present invention refers to a dispenser for a liquid medium consisting of two components".

Column 1, line 39, before "liquid" change "the" to --a--.

Column 2, line 19, change "FIG. 5 is" to --FIGS. 5A, 5B, and 5C, respectively, show--.

Column 2,line 53, change "liquid" to "liquids".

Column 3, line 15, change "As" to --as--.

Signed and Sealed this

Eleventh Day of May, 1999

*Attest:*

Q. TODD DICKINSON

*Attesting Officer*

*Acting Commissioner of Patents and Trademarks*